US007109960B2

(12) United States Patent
Wang et al.

(10) Patent No.: US 7,109,960 B2
(45) Date of Patent: Sep. 19, 2006

(54) DRIVING CIRCUIT FOR DISPLAY AND THE OPERATING METHOD THEREOF

(75) Inventors: Ching-Tung Wang, Hsinchu Hsien (TW); Hsu-Yu Yun, Hsinchu (TW); Yaw-Ming Tsai, Taichung (TW)

(73) Assignee: TPO Displays Corp., Miao-Li (TW)

( * ) Notice: Subject to any disclaimer, the term of this patent is extended or adjusted under 35 U.S.C. 154(b) by 347 days.

(21) Appl. No.: 10/604,128

(22) Filed: Jun. 27, 2003

(65) Prior Publication Data

US 2004/0196247 A1 Oct. 7, 2004

(51) Int. Cl.
*G09G 3/36* (2006.01)
*G09G 5/00* (2006.01)
*G09G 5/10* (2006.01)

(52) U.S. Cl. ..... 345/89; 345/99; 345/100; 345/212; 345/213; 345/690

(58) Field of Classification Search ..... 345/690, 345/87–101, 204–215
See application file for complete search history.

(56) References Cited

U.S. PATENT DOCUMENTS 6,816,139 B1 * 11/2004 Park ..... 345/87
2002/0093498 A1 * 7/2002 Park ..... 345/204
2002/0190974 A1 * 12/2002 Morita ..... 345/208
2003/0038766 A1 * 2/2003 Lee et al. ..... 345/87

* cited by examiner

*Primary Examiner*—Vijay Shankar
(74) *Attorney, Agent, or Firm*—Jianq Chyun IP Office

(57) ABSTRACT

A driving circuit for display and the operating method thereof are provided. The driving circuit uses the data controller with multi-gray scale to make the color driving signal correspond to the related gray of the multi-gray scale, and uses the inverter to output the color output signal to a display to make the color output signal have more levels of color, such that it can achieve the aim of full color. As the invention does not require use of the memory and digital to analog converter, which consume large amounts of power, it can achieve the aim of saving power.

13 Claims, 2 Drawing Sheets

DRIVING CIRCUIT FOR DISPLAY AND THE OPERATING METHOD THEREOF

BACKGROUND OF INVENTION

1. Field of Invention

The present invention relates to a driving circuit and the operating method thereof, and more particularly, to a driving method for display and the operating method thereof.

2. Description of Related Art

The field of flat panel displays comprises the LCD (Liquid Crystal Display), FED (Field Emission Display), OLED (Organic Light Emitting Diode), and PDP (Plasma Display Panel). The LCD is characterized by its slim size, light weight, and capability of being small, medium and large scale, and has become the most notable type in this field. The LCD is also suitable for using in the current and next generation''s mobile wireless communication and network technologies.

The LCD is widely applied in various electronic products now. In mobile electronic products, since the power charging capability of the battery is limited, the power saving design is always a major subject of concern, and the power saving capability for each of the related modules in the LCD is one of the major objects to be improved. The currently used LCD driving circuit consumes a great amount of electric power, since the color driving signal input into the driving circuit needs to be stored in the memory (e.g. SDRAM), and the color driving signal needs to be processed by the D/A (digital to analog) converter after it is processed by the data controller, so as to output an analog color output signal to display. The reason it consumes a great amount of electric power is that the memory and the digital to analog converter are continuously in operation, thus resulting in a great amount of electric power consumption. Therefore, how to reduce the electric power consumed the LCD driving circuit is a problem which urgently needs to be addressed by the developers.

In order to have a better understanding, please refer to FIG. 1. It schematically shows a block diagram of a conventional driving circuit for a display. As shown in the diagram, the driving circuit 10 comprises a timing controller 102, a memory (e.g. SDRAM) 104, a data controller 106, and a digital to analog converter 108. Wherein, the timing controller 102 receives a color driving signal, a clock signal (CLK), a horizontal synchronization signal (HSYNC), a vertical synchronization signal (VSYNC), and a differential enable signal (DE). The operating method for the driving circuit 10 is described hereinafter. At first, the timing controller 102 receives the color driving signal (e.g. a 6-bit color driving signal) that has been processed by a processor (not shown), and then the color driving signal is stored into the memory 104. Then, the color driving signal is sent to the digital to analog converter 108 via the data controller 106. An analog color output signal output from the digital to analog converter 108 is sent to the display 110 (e.g. LCD) for displaying its picture colors. Since the timing controller 102 continuously receives the color driving signal, the memory 104 and the digital to analog converter 108 are continuously operated. Therefore, the driving circuit 10 consumes a great amount of electric power.

The operating method mentioned above is a conventional color driving method for a display. The other color driving method for a display in prior art generates better picture quality by controlling each picture and by using the characteristic of persistence of vision. Similarly, it also consumes a great amount of electric power. Therefore, how to reduce the electric power consumed by the driving circuit for display and also give attention to picture quality has become an important research object.

SUMMARY OF INVENTION

The present invention provides a driving circuit for display and the operating method thereof. The present invention uses the data controller with multi-gray scale to make the color driving signal correspond to the related gray of the multi-gray scale, and uses the inverter to output the color output signal to the display to make the color output signal have more levels of color, such that it can achieve the object of full color. As the invention does not require use of the memory and digital to analog converter, which consume a large amount of power, it can achieve the object of saving power.

In order to achieve the object mentioned above and others, the present invention provides a driving circuit for display. The driving circuit comprises a timing controller, a data controller, and an inverter. The timing controller receives the color driving signal and outputs the color driving signal according to the timing of the timing controller. The data controller having multi-gray scale is coupled to the timing controller to receive the color driving signal, and make the color driving signal correspond to the related gray of the multi-gray scale according to the multi-gray scale, so as to output the gray-level signal. The inverter is coupled to the data controller to receive the gray-level signal and to invert the gray-level signal, so as to output the color output signal to the display.

In the embodiment of the present invention, the inverter inverts the gray-level signal according to the voltage level of the gray-level signal.

In the embodiment of the present invention, the timing controller receives CLK, HSYNC, VSYNC, and DE signals.

In the embodiment of the present invention, the driving circuit is an ASIC (Application Specific Integrated Circuit).

In the embodiment of the present invention, the display is an LCD (Liquid Crystal Display).

The present invention further provides an operating method for the driving circuit of a display. The operating method comprises: at first, receiving the color driving signal, and outputting the color driving signal according to the timing; then receiving the color driving signal, and making the color driving signal correspond to the related gray of the multi-gray scale according to the multi-gray scale, so as to output the gray-level signal; and then inverting the gray-level signal, so as to output the color output signal to the display.

In the embodiment of the present invention, the multi-gray scale is included in the data controller of the driving circuit.

In the embodiment of the present invention, the gray-level signal is inverted by the inverter in the driving circuit, and the inverter inverts the gray-level signal according to the voltage level of the gray-level signal.

In the embodiment of the present invention, the timing controller in the driving circuit is used to receive the color driving signal, and output the color driving signal according to the timing.

In summary, the present invention uses the data controller with multi-gray scale to make the color driving signal correspond to the related gray of the multi-gray scale, and uses the inverter to output the color output signal to the display to make the color output signal have more levels of color, such that it can achieve the object of full color. As the invention does not require use the memory and digital to analog converter, which consume large amounts of power, it can achieve the object of saving power.

BRIEF DESCRIPTION OF DRAWINGS

The accompanying drawings are included to provide a further understanding of the invention, and are incorporated in and constitute a part of this specification. The drawings illustrate embodiments of the invention, and together with the description, serve to explain the principles of the invention.

DETAILED DESCRIPTION

Figure 2:
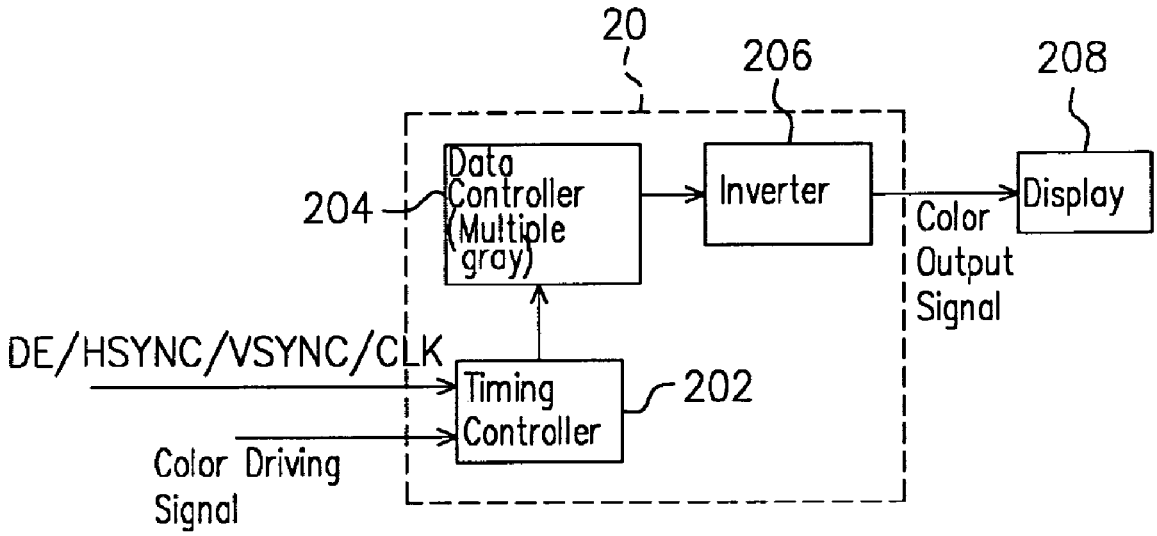
FIG. 2 schematically shows a block diagram of a driving circuit for display of a preferred embodiment according to the present invention.

FIG. 2 schematically shows a block diagram of a driving circuit for display of a preferred embodiment according to the present invention. As shown in FIG. 2, the driving circuit 20 comprises a timing controller 202, a data controller 204, and an inverter 206. The driving circuit 20 is, for example, an ASIC (Application Specific Integrated Circuit). Under the condition of reducing the consumed electric power, the driving circuit 20 makes the display 208 generate better picture quality with more levels of color, so as to achieve the object of saving power and providing full color. The function of each component in the driving 20 is described hereinafter.

The timing controller 202 receives the color driving signal that is processed and output by the processor (not shown), and outputs the color driving signal according to the timing of the timing controller 202. Further, the timing controller 202 receives the CLK, HSYNC, VSYNC, and DE signals.

The data controller 204 having multi-gray scale is coupled to the timing controller 202 to receive the color driving signal, and make the color driving signal correspond to the related gray of the multi-gray scale according to the multi-gray scale, so as to output the gray-level signal. A 6-bit color driving signal can map to 64 different gray levels.

The inverter 206 is coupled to the data controller 204 to receive the gray-level signal and to invert the gray-level signal, so as to output the color output signal to the display. In the preferred embodiment, the inverter 206 inverts the gray-level signal according to the voltage level of the gray-level signal. For example, assuming that the green signal is in low voltage level in some gray-level signal, after it is inverted by the inverter 206, the 4.2V green output signal is output to the display 208, so that the green pixel in the picture is displaying bright. If the green signal is in high voltage level in some gray-level signal, after it is inverted by the inverter 206, the 0V green output signal is output to the display 208, so that the green pixel in the picture is displaying dark.

The operating method for the driving circuit 20 of the present invention is described hereinafter with referrence to FIG. 2. At first, the timing controller 202 receives the color driving signal, and outputs the color driving signal according to the timing of the timing controller 202. The data controller 204 receives the color driving signal, and makes the color driving signal correspond to the related gray of the multi-gray scale, so as to output the gray-level signal. Then, the inverter 206 inverts the gray-level signal according to the voltage level of the gray-level signal to output the color output signal to the display 208, so that the picture quality of the display 208 is near to full color.

Figure 1:
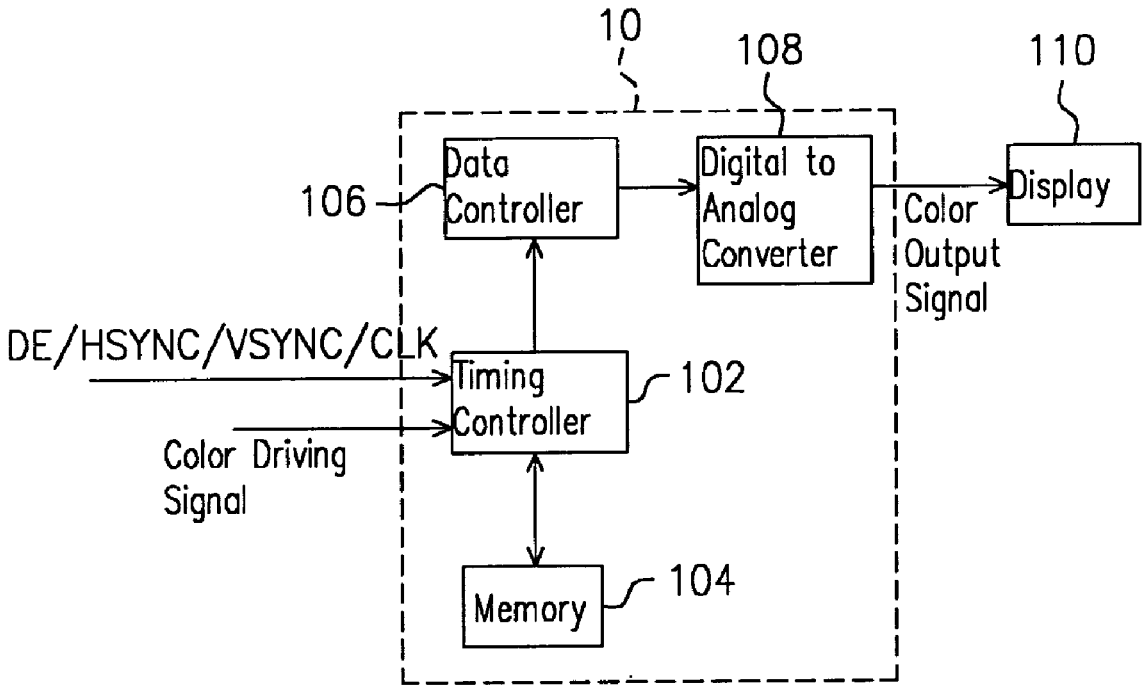
FIG. 1 schematically shows a block diagram of a conventional driving circuit for display.

Comparing FIG. 1 and FIG. 2, it is shown that the present invention replaces the conventional memory 104 and data controller 106 with the data controller 204 with multi-gray scale, and replaces the digital to analog converter 108 with the inverter. Since the electric power consumed by the data controller 204 and the inverter 206 is much less than the electric power consumed by the memory 104, data controller 106, and the digital to analog converter 108, the present invention can achieve the object of saving power.

In summary, the present invention uses the data controller with multi-gray scale to make the color driving signal correspond to the related gray of the multi-gray scale, and uses the inverter to output the color output signal to the display to make the color output signal have more levels of color, such that it can achieve the object of full color. As the invention does not require use of the memory and digital to analog converter, which consume large amounts of power, it can achieve the object of saving power.

Although the invention has been described with reference to a particular embodiment thereof, it will be apparent to one of ordinary skill in the art that modifications to the described embodiment may be made without departing from the spirit of the invention. Accordingly, the scope of the invention will be defined by the attached claims not by the above detailed description.

The invention claimed is:

1. A driving circuit for a display, comprising:

a timing controller, used to receive a color driving signal, and to output a corresponding color driving signal according to a timing of the timing controller;

a data controller, having a multi-gray scale, wherein the data controller is coupled to the timing controller to receive the color driving signal, and to make the color driving signal correspond to a related gray of the multi-gray scale according to the multi-gray scale, so as to output a gray-level signal; and an inverter, coupled to the data controller to receive the gray-level signal and to invert the gray-level signal, so as to output a color output signal to the display, wherein the driving circuit does not include a digital to analog converter (DAC).

2. The driving circuit for the display of claim 1, wherein the inverter inverts the gray-level signal according to a voltage level of the gray-level signal.

3. The driving circuit for the display of claim 1, wherein the timing controller is further used to receive a clock signal (CLK), a horizontal synchronization signal (HSYNC), a vertical synchronization signal (VSYNC), and a differential enable signal (DE).

4. The driving circuit for the display of claim 1, wherein the driving circuit is an ASIC (Application Specific Integrated Circuit).

5. The driving circuit for the display of claim 1, wherein the display is a LCD (Liquid Crystal Display).

6. An operating method for a display driving circuit, comprising:

receiving a color driving signal, and outputting a corresponding color driving signal according to a timing;

receiving the color driving signal, and making the color driving signal correspond to a related gray of a multi-gray scale according to the multi-gray scale, so as to output a gray-level signal; and inverting the gray-level signal, so as to output a color output signal to the display, wherein the display driving circuit does not include a digital to analog converter (DAC).

7. The operating method for the display driving circuit of claim 6, wherein the multi-gray scale is included in a data controller in the driving circuit.

8. The operating method for the display driving circuit of claim 6, wherein the gray-level signal is inverted by an inverter in the driving circuit.

9. The operating method for the display driving circuit of claim 8, wherein the inverter inverts the gray-level signal according to a voltage level of the gray-level signal.

10. The operating method for the display driving circuit of claim 6, wherein a timing controller in the driving circuit is used to receive the color driving circuit, and output the color driving circuit according to the timing.

11. The operating method for the display driving circuit of claim 10, wherein the timing controller is further used to receive a clock signal (CLK), a horizontal synchronization signal (HSYNC), a vertical synchronization signal (VSYNC), and a differential enable signal (DE).

12. The operating method for the display driving circuit of claim 6, wherein the driving circuit is an ASIC (Application Specific Integrated Circuit).

13. The operating method for the display driving circuit of claim 6, wherein the display is an LCD (Liquid Crystal Display).

* * * * *